US009722376B2

(12) United States Patent
Kim et al.

(10) Patent No.: US 9,722,376 B2
(45) Date of Patent: Aug. 1, 2017

(54) CONNECTING DEVICE AND METHOD FOR RECOGNIZING DEVICE

(71) Applicant: Samsung Electronics Co., Ltd., Suwon-si, Gyeonggi-do (KR)

(72) Inventors: Won Seob Kim, Seoul (KR); Eun Seok Hong, Suwon-si (KR); Shin Ho Kim, Yongin-si (KR); Gyoung Hwan Park, Seoul (KR); Dong Ho Yu, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/195,333

(22) Filed: Jun. 28, 2016

(65) Prior Publication Data

US 2017/0005447 A1 Jan. 5, 2017

(51) Int. Cl.

| | |
|---|---|
| ***H01R 27/00*** | (2006.01) |
| ***H01R 31/06*** | (2006.01) |
| ***H01R 29/00*** | (2006.01) |
| ***H01R 13/66*** | (2006.01) |
| ***H01R 24/60*** | (2011.01) |
| ***H01R 27/02*** | (2006.01) |
| *H01R 107/00* | (2006.01) |

(52) U.S. Cl.

CPC ..... *H01R 31/06* (2013.01); *H01R 13/6616* (2013.01); *H01R 13/6683* (2013.01); *H01R 24/60* (2013.01); *H01R 27/02* (2013.01); *H01R 29/00* (2013.01); *H01R 2107/00* (2013.01)

(58) Field of Classification Search

CPC ..... H01R 27/00; H01R 31/06; H01R 29/00; H01R 13/665; H01R 13/6658; G06F 1/189; G06F 11/325; G06F 1/20; G06F 11/221

USPC ..... 439/620.24, 638, 489, 488

See application file for complete search history.

(56) References Cited

U.S. PATENT DOCUMENTS

| | | | | |
|---|---|---|---|---|
| 4,696,527 A * | 9/1987 | Ding | A61B 5/0428 | 338/220 |
| 5,873,751 A * | 2/1999 | Daly | H05K 1/0278 | 361/761 |
| 7,341,474 B2 * | 3/2008 | Clem | G01R 15/04 | 439/424 |
| 8,529,297 B2 * | 9/2013 | Chang | H01R 13/6658 | 439/620.09 |
| 8,581,619 B2 | 11/2013 | Singh et al. | | |
| 9,106,219 B2 | 8/2015 | Singh et al. | | |

(Continued)

FOREIGN PATENT DOCUMENTS

| | | |
|---|---|---|
| EP | 2 833 348 A1 | 2/2015 |
| EP | 2 860 639 A1 | 4/2015 |
| EP | 2 961 008 A1 | 12/2015 |

OTHER PUBLICATIONS

Universal Serial Bus Type-C Cable and Connector Specification, Apr. 3, 2015, XP055208232, Retrieved from the Internet: URL:http://WWW.usb.org/developers/docs/.

*Primary Examiner* — Gary Paumen

(74) *Attorney, Agent, or Firm* — Jefferson IP Law, LLP

(57) ABSTRACT

A connecting device is provided. The connecting device includes a first connector having a first pin row, a second connector having a second pin row, a data line connecting a data pin of the first pin row and a data pin of the second pin row, and a recognition line connecting a power pin of the first pin row and a recognition pin of the second pin row through a physical element.

11 Claims, 7 Drawing Sheets

(56) References Cited

U.S. PATENT DOCUMENTS

| | | | | |
|---|---|---|---|---|
| 2005/0070163 | A1* | 3/2005 | Redmond | H01R 13/514 439/620.24 |
| 2009/0253302 | A1* | 10/2009 | Li | H01R 13/6616 439/620.24 |
| 2012/0013346 | A1* | 1/2012 | Xu | G06F 11/221 324/543 |
| 2012/0162898 | A1* | 6/2012 | Weng | G06F 1/189 361/679.33 |
| 2013/0049797 | A1 | 2/2013 | Singh et al. | |
| 2013/0114200 | A1* | 5/2013 | Wu | G06F 11/325 361/679.31 |
| 2014/0070843 | A1 | 3/2014 | Singh et al. | |
| 2014/0141635 | A1* | 5/2014 | Saunders | G06F 13/4068 439/170 |
| 2015/0032918 | A1 | 1/2015 | Zhang et al. | |
| 2015/0106539 | A1 | 4/2015 | Leinonen et al. | |
| 2015/0372429 | A1* | 12/2015 | Lee | H01R 13/665 439/218 |
| 2016/0087386 | A1* | 3/2016 | Chien | H01R 12/724 439/518 |
| 2016/0299185 | A1* | 10/2016 | Peng | G06F 1/20 |

* cited by examiner

CONNECTING DEVICE AND METHOD FOR RECOGNIZING DEVICE

CROSS-REFERENCE TO RELATED APPLICATION(S)

This application claims the benefit under 35 U.S.C. §119 (a) of a Korean patent application filed on Jun. 30, 2015 in the Korean Intellectual Property Office and assigned Serial number 10-2015-0092917, the entire disclosure of which is hereby incorporated by reference.

TECHNICAL FIELD

The present disclosure relates to a connecting device that connects electronic devices and a method for recognizing a connecting device by an electronic device.

BACKGROUND

The electronic devices such as smartphones or tablets may be connected to various external devices. Such an electronic device may be connected to an accessory device or a USB storage device to transmit and receive signals for executing various functions.

A connecting device such as a cable or a gender may be used to connect the electronic device to an external device. The connecting device may match corresponding pins by connecting connectors of different sizes.

The connecting device according to the related art may directly connect two data pins to one data pin to form a separate branch line (or stub). In this case, the branch line may be a separate signal route and may cause problems such as recognition errors or connection defects when signals are transmitted and received.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a method for informing an electronic device of a coupling state of a connecting device through a recognition pin (for example, pin channel configuration (CC) of universal serial bus (USB) 3.X) and determining a data line, through which signals are transmitted and received, by using a measurement value associated with the recognition pin, and a connecting device.

In accordance with an aspect of the present disclosure, a connecting device is provided. The connecting device includes a first connector having a first pin row, a second connector having a second pin row, a data line connecting a data pin of the first pin row and a data pin of the second pin row, and a recognition line connecting a power pin of the first pin row and a recognition pin of the second pin row through a physical element.

In accordance with another aspect of the present disclosure, a method for recognizing a device by an electronic device that is connected to an external device through a connector is provided. The method includes measuring first and second voltage values applied to first and second pull-down resistors connected to first and second recognition pins of the connector, respectively, determining one of first and second sub pin rows provided in the connector, to and from which data are transmitted and received, based on the measured first and second voltages, and transmitting and receiving a signal through the determined sub pin row.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
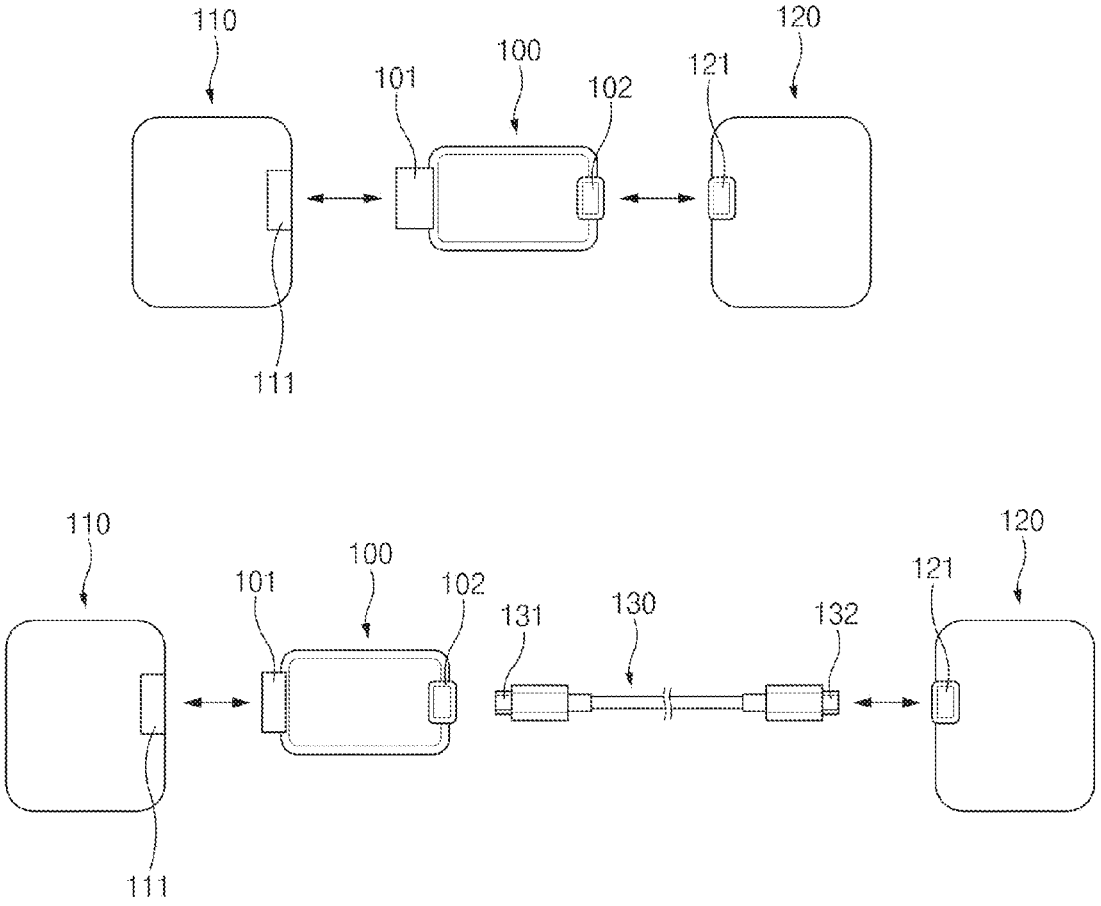
FIG. 1 illustrates a connection of first and second electronic devices using a connecting device according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In the disclosure disclosed herein, the expressions "have", "may have", "include" and "comprise", or "may include" and "may comprise" used herein indicate existence of corresponding features (for example, elements such as numeric values, functions, operations, or components) but do not exclude presence of additional features.

In the disclosure disclosed herein, the expressions "A or B", "at least one of A or/and B", or "one or more of A or/and B", and the like used herein may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The terms, such as "first", "second", and the like used herein may refer to various elements of various embodiments of the present disclosure, but do not limit the elements. For example, such terms are used only to distinguish an element from another element and do not limit the order and/or priority of the elements. For example, a first user device and a second user device may represent different user devices irrespective of sequence or importance. For example, without departing the scope of the present disclosure, a first element may be referred to as a second element, and similarly, a second element may be referred to as a first element.

It will be understood that when an element (for example, a first element) is referred to as being "(operatively or communicatively) coupled with/to" or "connected to" another element (for example, a second element), it can be directly coupled with/to or connected to the other element or an intervening element (for example, a third element) may be present. In contrast, when an element (for example, a first element) is referred to as being "directly coupled with/to" or "directly connected to" another element (for example, a second element), it should be understood that there is no intervening element (for example, a third element).

According to the situation, the expression "configured to" used herein may be used as, for example, the expression "suitable for", "having the capacity to", "designed to", "adapted to", "made to", or "capable of". The term "configured to (or set to)" must not mean only "specifically designed to" in hardware. Instead, the expression "a device configured to" may mean that the device is "capable of" operating together with another device or other components, central processing unit (CPU), for example, a "processor configured to (or set to) perform A, B, and C" may mean a dedicated processor (for example, an embedded processor) for performing a corresponding operation or a generic-purpose processor (for example, a CPU or an application processor) which may perform corresponding operations by executing one or more software programs which are stored in a memory device.

Terms used in this specification are used to describe specified embodiments of the present disclosure and are not intended to limit the scope of the present disclosure. The terms of a singular form may include plural forms unless otherwise specified. Unless otherwise defined herein, all the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal detect unless expressly so defined herein in various embodiments of the present disclosure. In some cases, even if terms are terms which are defined in the specification, they may not be interpreted to exclude embodiments of the present disclosure.

An electronic device according to various embodiments of the present disclosure may include at least one of smartphones, tablet personal computers (PCs), mobile phones, video telephones, electronic book readers, desktop PCs, laptop PCs, netbook computers, workstations, servers, personal digital assistants (PDAs), portable multimedia players (PMPs), MP3 players, mobile medical devices, cameras, and wearable devices. According to various embodiments of the present disclosure, the wearable devices may include accessories (for example, watches, rings, bracelets, ankle bracelets, glasses, contact lenses, or head-mounted devices (HMDs)), cloth-integrated types (for example, electronic clothes), body-attached types (for example, skin pads or tattoos), or implantable types (for example, implantable circuits).

In some embodiments of the present disclosure, the electronic device may be one of home appliances. The home appliances may include, for example, at least one of a digital video disk (DVD) player, an audio, a refrigerator, an air conditioner, a cleaner, an oven, a microwave oven, a washing machine, an air cleaner, a set-top box, a home automation control panel, a security control panel, a TV box (for example, Samsung HomeSync™, Apple TV™, or Google TV™), a game console (for example, Xbox™ or PlayStation™), an electronic dictionary, an electronic key, a camcorder, or an electronic panel.

In another embodiment of the present disclosure, the electronic device may include at least one of various medical devices (for example, various portable medical measurement devices (a blood glucose meter, a heart rate measuring device, a blood pressure measuring device, and a body temperature measuring device), a magnetic resonance angiography (MRA), a magnetic resonance imaging (MRI) device, a computed tomography (CT) device, a photographing device, and an ultrasonic device), a navigation system, a global navigation satellite system (GNSS), an event data recorder (EDR), a flight data recorder (FDR), a vehicular infotainment device, electronic devices for vessels (for example, a navigation device for vessels and a gyro compass), avionics, a security device, a vehicular head unit, an industrial or home robot, an automatic teller's machine (ATM) of a financial company, a point of sales (POS) of a store, an internet of things (for example, a bulb, various sensors, an electricity or gas meter, a spring cooler device, a fire alarm device, a thermostat, an electric pole, a toaster, a sporting apparatus, a hot water tank, a heater, and a boiler).

According to some embodiments of the present disclosure, the electronic device may include at least one of a furniture or a part of a building/structure, an electronic board, an electronic signature receiving device, a projector, or various measurement devices (for example, a water service, electricity, gas, or electric wave measuring device). In various embodiments of the present disclosure, the electronic device may be one or a combination of the aforementioned devices. The electronic device according to some embodiments of the present disclosure may be a flexible electronic device. Further, the electronic device according to an embodiment of the present disclosure is not limited to the aforementioned devices, but may include new electronic devices produced due to the development of technologies.

Hereinafter, electronic devices according to an embodiment of the present disclosure will be described with reference to the accompanying drawings. The term "user" used herein may refer to a person who uses an electronic device or may refer to a device (for example, an artificial electronic device) that uses an electronic device.

FIG. 1 illustrates a connection of first and second electronic devices using a connecting device according to an embodiment of the present disclosure.

Referring to FIG. 1, the connecting device 100 may connect a first electronic device 110 and a second electronic device 120.

The first electronic device 110 is a device that is connected to the outside through a connector 111 of a first type (hereinafter, a first type connector), and may be a personal computer (PC), a laptop, or a TV. In various embodiments, the first type connector 111 may be symmetrical in a first direction (for example, a transverse direction), but may not be symmetrical in a second direction (for example, a longitudinal direction) that is perpendicular to the first direction. It may be impossible to convert the direction of the connector and insert the connector. The first type may be universal serial bus (USB) type A, USB type B, or USB type micro B. Although it will be mainly described in the following that the first type is USB type A, the present disclosure is not limited thereto.

The second electronic device 120 is a device that is connected to the outside through a connector 120 of a second type (hereinafter, a second type connector), and may be a smartphone or a tablet. In various embodiments, the second type connector 121 may be symmetrical in a first direction (for example, a transverse direction), but may not be symmetrical in a second direction (a longitudinal direction) that is perpendicular to the first direction. It may be possible to convert the direction of the connector and insert the connector. The second type may be USB type C. Although it will be mainly described in the following that the second type is USB type C, the present disclosure is not limited thereto.

The connecting device 100 may include a first connector 101 connected to the first electronic device 110 and a second connector 102 connected to the second electronic device 120.

The first connector 101 may be connected to the first type connector 111 mounted on the first electronic device 110. The first connector 101 may have a form corresponding to the first type connector 111. For example, the first type connector 111 may be a socket type connector based on USB type A, and the first connector 101 may be an insertion type connector based on USB type A.

In various embodiments, when the first connector 101 and the first type connector 111 correspond to USB 3.2 (type A), the first connector 101 and the first type connector 111 may include a pin row that includes first to ninth pins. When the first connector 101 is inserted into the first type connector 111, it may be inserted in a direction but it may be impossible to convert the direction of the connector and insert the connector. For example, the first connector 101 may be inserted in the state in which a first surface (for example, an upper end surface) thereof is disposed on the same plane as an upper end surface of the first type connector 111, and it may be impossible to connect the first connector 101 when a second surface (for example, a lower end surface) thereof is disposed on the same plane as the upper end surface of the first type connector 111.

The second connector 102 may be connected to the second type connector 121 mounted on the second electronic device 120. The second connector 102 may have a form corresponding to the second type connector 121. For example, the second type connector 102 may be a socket type connector based on USB type C, and the second connector 121 may be an insertion type connector based on USB type C.

In various embodiments, when the second connector 102 and the second type connector 121 correspond to USB 3.1 (type C), the second connector 102 and the second type connector 121 may include a first sub pin row and a second sub pin row that is symmetrical to the first sub pin row. The first sub pin row may have an arrangement of pins that are symmetrical to those of the second sub pin row. For example, the first sub pin row includes first to twelfth pins that face a first surface of the second connector 102, and the second sub pin row may include thirteenth to twenty-fourth pins that face a second surface opposite to the first surface.

The second connector 102 may be connected to the second type connector 121 without any restriction on a direction in which the second connector 102 is inserted, unlike the first connector 101. For example, the second connector 102 may be inserted in the state in which a first surface (for example, an upper end surface) thereof is disposed on the same plane as an upper end surface of the second type connector 121, and may be inserted while the first surface (for example, the upper end surface) thereof is disposed on the same plane as a lower end surface of the second type connector 121.

According to various embodiments, the connecting device 100 may have a circuit board (for example, a PCB) in the interior thereof. Data lines that connect pins of the first connector 101 and pins of the second connector 102, signal lines such as recognition lines, and a circuit (for example, a physical element) for representing the characteristics of the connecting device 101 may be mounted on the circuit board (not illustrated).

According to various embodiments, the connecting device 100 may include a housing for mounting and protecting the circuit board and the internal configurations. The exterior of the connecting device 100 may be formed such that the housing is partially exposed or a separate case is attached to the housing.

According to various embodiments, the connecting device 100 may connect the first connector 101 and the second connector 102 of different types in the interior thereof. The connecting device 100 may be implemented to allow the second connector 102 to be inserted into the second electronic device 120 or the cable 130 after the direction of the second connector 102 is converted (a flip ability). The connecting device 100 may minimize formation of separate branch lines (stubs) for the data lines connected to the second electronic device 102 and may prevent distortion of signals.

For example, when the first connector 101 is USB 3.0 type A and the second connector is USB 3.1 type C, two data pins included in the second connector 102 may correspond to one data pin included in the first connector 101. The connecting device 100 may connect a power pin of the first connector 101 to a recognition pin (for example, pin CC) of the second connector 102 through a separate physical element (for example, a resistor). The second electronic device 120 may determine a data pin, to and from which data are transmitted and received, through a value (for example, a voltage value) measured in association of the physical element.

According to various embodiments, the cable 130 may be additionally inserted between the connecting device 100 and the second electronic device 120. The cable 130 may include a first cable connector 131 and a second cable connector 132. The first cable connector 131 may have the same form as the second type connector 121 included in the second electronic device 120. The second cable connector 132 may have the same form as the second connector 102 included in the connecting device 100.

According to various embodiments, the cable 130 may include a signal line corresponding to one of the first sub pin row and the second sub pin row included in the second connector 102 (or the second type connector 121). In this case, the second electronic device 120 may determine a sub pin row connected to a cable 130, by using a value (for example, a voltage value) measured in association with a physical element included in the connecting device 100. When the cable 130 includes a signal line corresponding to one of the first sub pin row and the second sub pin row, manufacturing costs of the cable 130 may be reduced.

According to various embodiments, the cable 130 may be implemented to be integral with the connecting device 100 (hereinafter, referred to as a cable integrated device). The cable integrated device may be formed such that the exterior materials of the connecting device 100 and the cable 130 are integrally injection-molded. The internal configuration of the cable integrated device may be the same as the connection form of the connecting device 100 and the cable 130.

Figure 2:
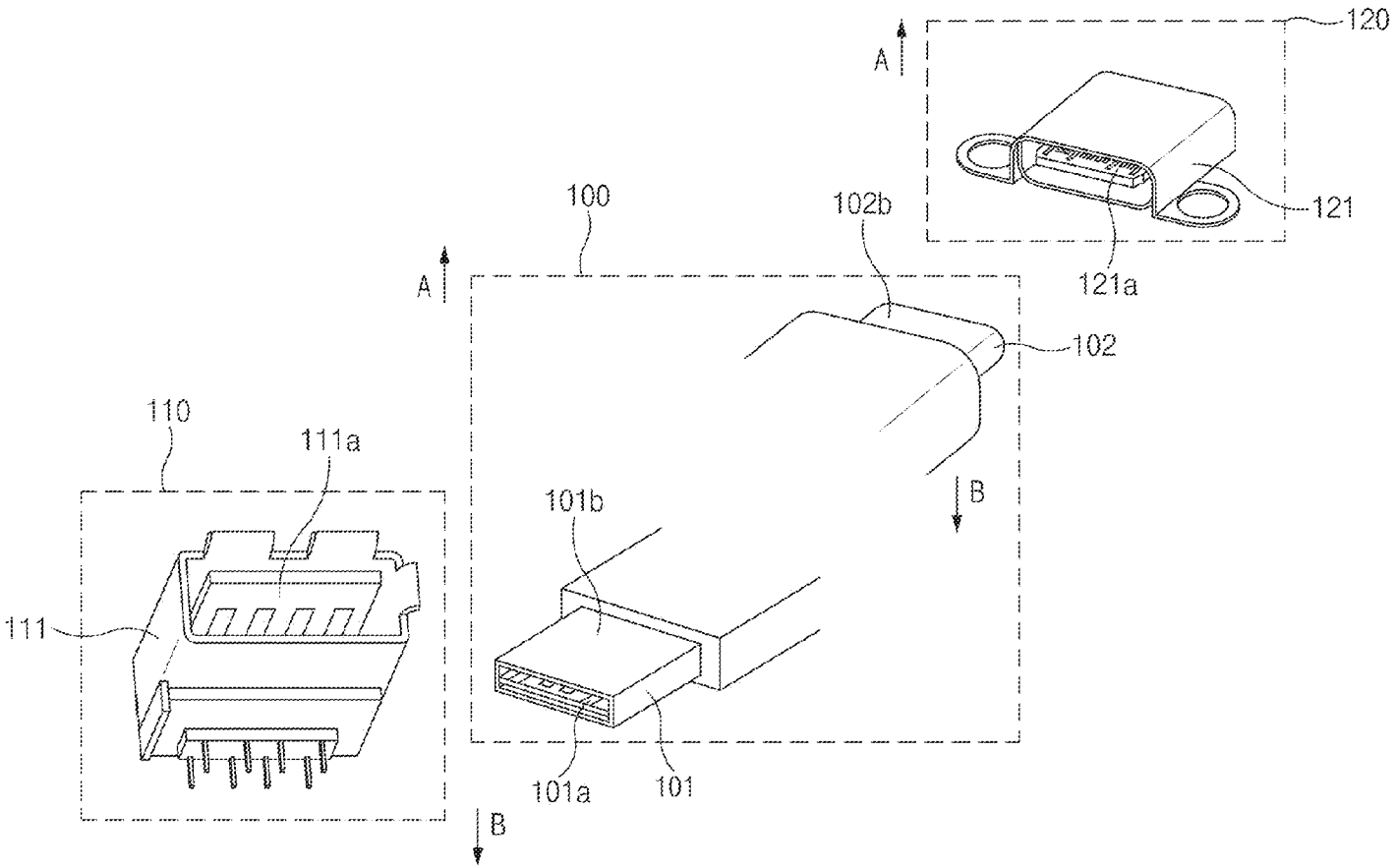
FIG. 2 illustrates a connector included in a connecting device and a peripheral electronic device according to an embodiment of the present disclosure.

FIG. 2 illustrates a connector included in a connecting device and a peripheral electronic device according to an embodiment of the present disclosure. FIG. 2 illustrates that the first connector 101 corresponds to USB type A and the second connector 102 corresponds to USB type C, but the present disclosure is not limited thereto.

Referring to FIG. 2, the connecting device 100 may include a first connector 101 and a second connector 102.

The first connector 101 may be connected to the first type connector 111 mounted on the first electronic device 110. According to various embodiments, the first connector 101 may be an insertion type connector based on USB type A. The first connector 101 may include a first pin row 101*a* including a plurality of pins. For example, the first pin row 101*a* may include first to ninth pins (for example, a power pin, a ground pin, and data pins Tx and Rx) based on the USB 3.0 standard.

The first type connector 111 may be mounted on the first electronic device 110, and may be a socket type connector corresponding to the first connector 101. The first type connector 111 may include a socket inside pin row 111*a* including a plurality of pins. The socket inside pin row 111*a* may have an arrangement of pins corresponding to the first pin row 101*a* of the first connector 101. The socket inside pin row 111*a* may include first to ninth pins (for example, a power pin, a ground pin, and data pins Tx and Rx) based on the USB 3.0 standard, like the first pin row 101*a*. When the first connector 101 is inserted into the first type connector 111, the first pin row 101*a* may make contact with the socket inside pin row 111*a* and may be connected to corresponding pins. The pins may transmit and receive data.

The first connector 101 may be inserted into the first type connector 111 in a specific direction. For example, the first connector 101 may be inserted while a first surface 101*b* (for example, an upper end surface) thereof faces direction A, but it may be impossible to insert the first connector 101 while the first surface 102*b* faces direction B.

The second connector 102 may be connected to the second type connector 121 mounted on the second electronic device 120. According to various embodiments, the second connector 102 may be an insertion type connector based on USB type C. The second connector 102 may include a second pin row (not illustrated) including a plurality of pins. For example, the second pin row may include first to twenty fourth pins (for example, a power pin, a ground pin, and data pins Tx and Rx) based on the USB 3.1 standard. The second pin row may include a first sub pin row including first to twelfth pins disposed (or exposed) in direction A and a second sub pin row including thirteenth to twenty-fourth pins disposed (or exposed) in direction B. The first sub pin row may have an arrangement of pins that are symmetrical to those of the second sub pin row.

According to various embodiments, when the second connector 102 is connected to the second type connector 121, it may be connected irrespective of an insertion direction thereof (a flip ability). The second connector 102 may be connected to the second type connector 121 while the first surface 102*b* thereof faces direction A, and may be connected to the second type connector 121 while the first surface 102*b* faces direction B. Unlike the first connector 101, the user may connect the second connector 102 to the second type connector 121 irrespective of an insertion direction thereof.

The second type connector 121 may be included in the second electronic device 120, and may be a socket type corresponding to the second connector 102. The second type connector 121 may include a socket inside pin row 121*a* including a plurality of pins based on USB type C. For example, the second inside pin row 121*a* may include first to twenty-fourth pins (for example, a power pin, a ground pin, and data pins Tx and Rx) based on the USB 3.1 standard. Like the second connector 102, the socket inside pin row 121*a* may have a symmetrical form in which twelve pins are disposed in direction A and twelve pins are disposed in direction B. The user may insert the second type connector 121 into the second connector 102 to connect the second type connector 121 irrespective of a direction thereof.

When the second type connector 121 is inserted into the second connector 102, the socket inside pin row 121*a* may make contact with a second pin row (not illustrated) of the second connector 102 and may be connected to corresponding pins. The pins may transmit and receive data.

Figure 3:
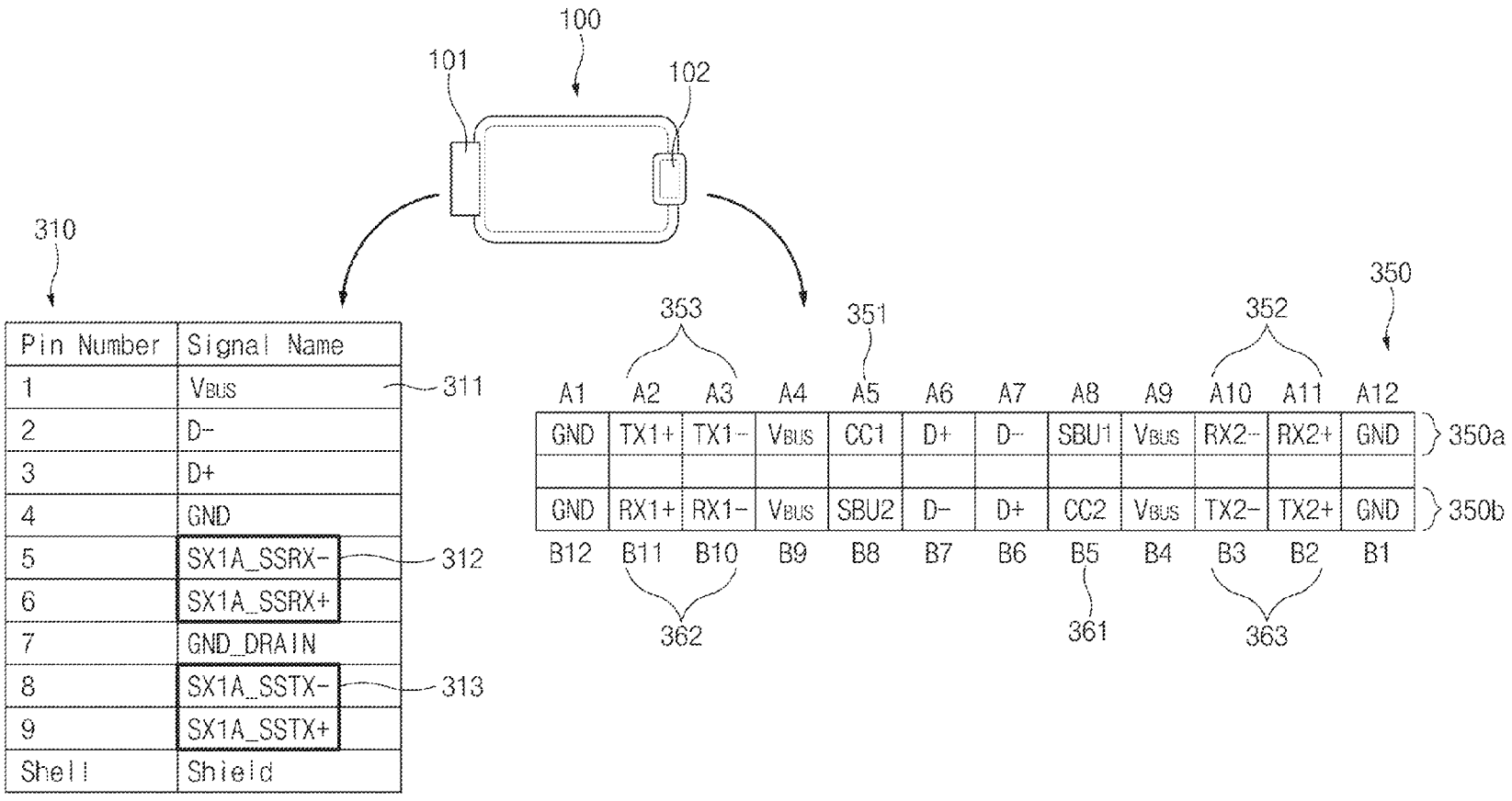
FIG. 3 illustrates a configuration of pins included in a connecting device according to an embodiment of the present disclosure.

FIG. 3 illustrates a configuration of pins included in a connecting device according to an embodiment of the present disclosure. However, FIG. 3 is exemplary and the present disclosure is not limited thereto.

Referring to FIG. 3, the connecting device 100 may include a first connector 101 and a second connector 102.

The first connector 101 may include a first pin row 310. The first pin row 301 may include first to ninth pins (for example, a power pin, a ground pin, and data pins Tx and Rx) based on the USB 3.0.

The power pin 311 may be a pin that receives a voltage (for example, a 5 V voltage) from the first electronic device 110 (a first pin, V_BUS).

The data pins 312 and 313 may include an RX pair pin 312 and a TX pair pin 313. The RX pair pin 312 may include an RX− pin (a fifth pin) and an RX+ pin (a sixth pin). The TX pair pin 313 may include a TX− pin (an eighth pin) and a TX+ pin (a ninth pin).

The second connector 102 may include a second pin row 350. The second pin row 350 may include a first sub pin row 350*a* and a second sub pin row 350*b* that are implemented to have a symmetrical arrangement.

The first sub pin row 350*a* may include first to twelfth pins (for example, a power pin, a ground pin, data pins Tx and Rx, and pin CC1) based on the USB 3.1.

The data pins of the first sub pin row 350*a* may include an RX pair pin 352 and a TX pair pin 353. The RX pair pin 352 may include an RX2− pin (pin A10) and an RX2+ pin (pin A11). The TX pair pin 353 may include a TX1+ pin (pin A2) and a TX1− pin (pin A3).

The second sub pin row 350*b* may have an arrangement that is symmetrical to the first sub pin row 350*a*, and may include thirteenth to twenty fourth (for example, a power pin, a ground pin, data pins (Tx and Rx), and pin CC2) based on USB 3.1.

The data pins of the second sub pin row 350*b* may include an RX pair pin 362 and a TX pair pin 353. The RX pair pin 362 may include an RX1− pin (pin B10) and an RX1+ pin (pin B11). The TX pair pin 363 may include a TX2+ pin (pin B2) and a TX2− pin (pin B3).

The data pins 312 and 313 of the first connector 101 may be connected to data pins of the first sub pin row 350*a* and the second sub pin row 350*b*. For example, the RX− pin (a fifth pin) of the first connector 101 may be connected to an RX2− pin (pin A10) of the first sub pin row 350*a* and an RX1− pin (pin B10) of the second sub pin row 350*b*. As another example, the TX+ pin (a ninth pin) of the first connector 101 may be connected to a TX2+ pin (pin A2) of the first sub pin row 350*a* and a TX2+ pin (pin B2) of the second sub pin row 350*b*.

According to various embodiments, one of the data pins of the first sub pin row 350*a* and the data pins of the second sub pin row 350*b*, which correspond to each other, may be connected to the second type connector 121 of the second electronic device 120 through the cable 130, and the other may not be connected to the second electronic device 120. The data pins that are not connected to the second electronic device 120 may not have a branch line (a stub) corresponding to the length of a cable, and accordingly may prevent distortion of signals by a branch line. In various embodiments, the second electronic device 120 may process signals for the data pins connected via the cable 130 through switching, and may interrupt signals for the other data pins that are not connected. The additional information of the switching method of the second electronic device 120 may be provided through FIGS. 5 and 6.

According to various embodiments, a first recognition pin 351 (pin CC1, A5) and a second recognition pin 361 (pin CC2, B5) may be pins for detecting a connection of a device, identifying a cable type, identifying an interface configuration, and identifying a vendor defined message. In various embodiments, the power pin 311 (a first pin, V_BUS) of the first connector 101 may be connected to the first recognition pin 351 (pin CC1, A5) and the second recognition pin 361 (pin CC2, B5) of the second connector 102 through a physical element (for example, a pull-up resistor). The second electronic device 120 may determine a sub pin row, to and from which signals are transmitted and received, based on a measurement value (for example, a voltage value) associated with the physical element (for example, a resistor). Additional information on the connection of the first recognition pin 351 and the second recognition pin 361 may be provided through FIG. 4.

Figure 4:
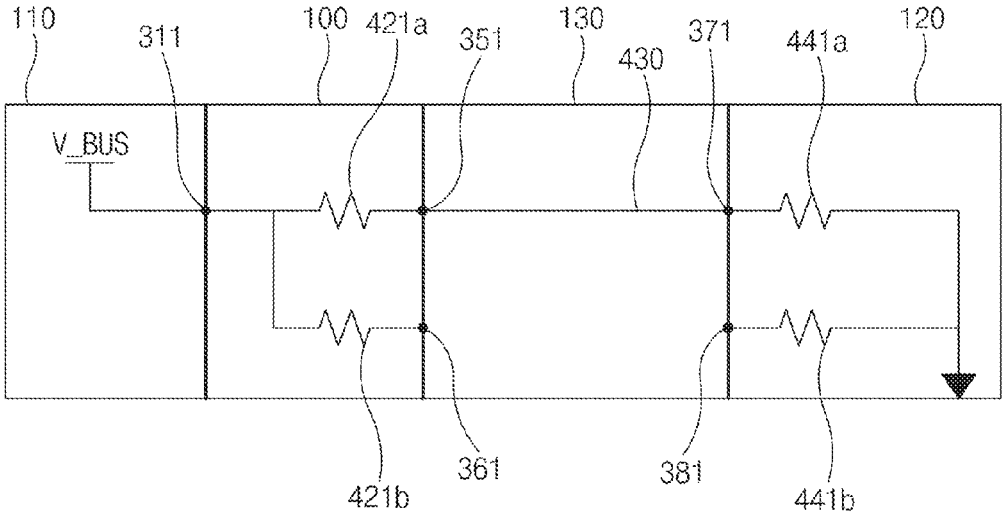
FIG. 4 illustrates a connection of a CC pin in the interior of a connecting device according to an embodiment of the present disclosure.

FIG. 4 illustrates a connection of a CC pin in the interior of a connecting device according to an embodiment of the present disclosure.

Referring to FIG. 4, the connecting device 100 and the cable 130 may connect a first electronic device 110 and a second electronic device 120.

The connecting device 100 may be connected to the first electronic device 110 through the first connector 101 connected to the first electronic device 110. According to various embodiments, the first connector 101 may be an insertion type connector based on USB type A.

The power pin 311 (V_BUS) of the first connector 101 may be connected to the first recognition pin 351 (for example, pin CC1) of the second connector 102 and the second recognition pin 361 (for example, pin CC2) through a physical element (for example, a first pull-up resistor 421*a* and a second pull-up resistor 421*b*). In various embodiments, the first pull-up resistor 421*a* and the second pull-up resistor 421*b* may have specific resistances, respectively, and may be connected to one of a first pull-down resistor 441*a* and a second pull-down resistor 441*b* included in the second electronic device 120 through the cable 130.

The cable 130 may connect the connecting device 100 and the second electronic device 120. The cable 130 may include a signal line 430 corresponding to one of the first sub pin row and the second sub pin row included in the second connector 102 (or the second type connector 121). Although FIG. 4 exemplarily illustrates that the signal line 430 is connected to the first recognition pin 351, the present disclosure is not limited thereto. For example, the signal line 430 may be connected to the second recognition pin 361, but a separate signal line may not be connected to the first recognition pin 351. In this case, the second pull-up resistor 421*b* may be connected to the second pull-down resistor 441*b* through the signal line 430.

The second electronic device 120 may determine a connected sub pin row based on a value (for example, a voltage value) measured in association with a physical element (for example, the first pull-up resistor 421*a* and the second pull-up resistor 421*b*) included in the connecting device 100.

The second electronic device 120 may include a first pull-down resistor 441*a* and a second pull-down resistor 441*b*. The first pull-down resistor 441*a* and the second pull-down resistor 441*b* may be connected to the recognition pins 371 and 381 included in the second type connector 121. A part of a voltage applied by the power pin 311 V_BUS of the first connector 101 through distribution of voltages may be applied to the first pull-down resistor 441*a* and the second pull-down resistor 441*b*.

For example, in FIG. 4, if a voltage of 5 V is applied to V_BUS and the first pull-up resistor 421*a* and the second pull-up resistor 421*b* have a resistance of 10 kΩ and the first pull-down resistor 441*a* and the second pull-down resistor 441*b* have a resistance of 5 kΩ, a voltage of about 1.67 may be applied to the first pull-down resistor 441*a*, to which the signal line 430 is connected, through distribution of voltages and a separate voltage may not be applied to the second pull-down resistor 441*b*, to which a signal line 430 is not connected.

The second electronic device 120 may measure a voltage value applied to opposite ends of the pull-down resistors, and may determine a connection of the connecting device 100 and a connected sub pin row through the signal line 430 based on the measured voltage value. The second electronic device 120 may transmit and receive signals through the determined sub pin row. The additional information of the configuration and operation of the second electronic device 120 may be provided through FIGS. 5 and 6.

Figure 5:
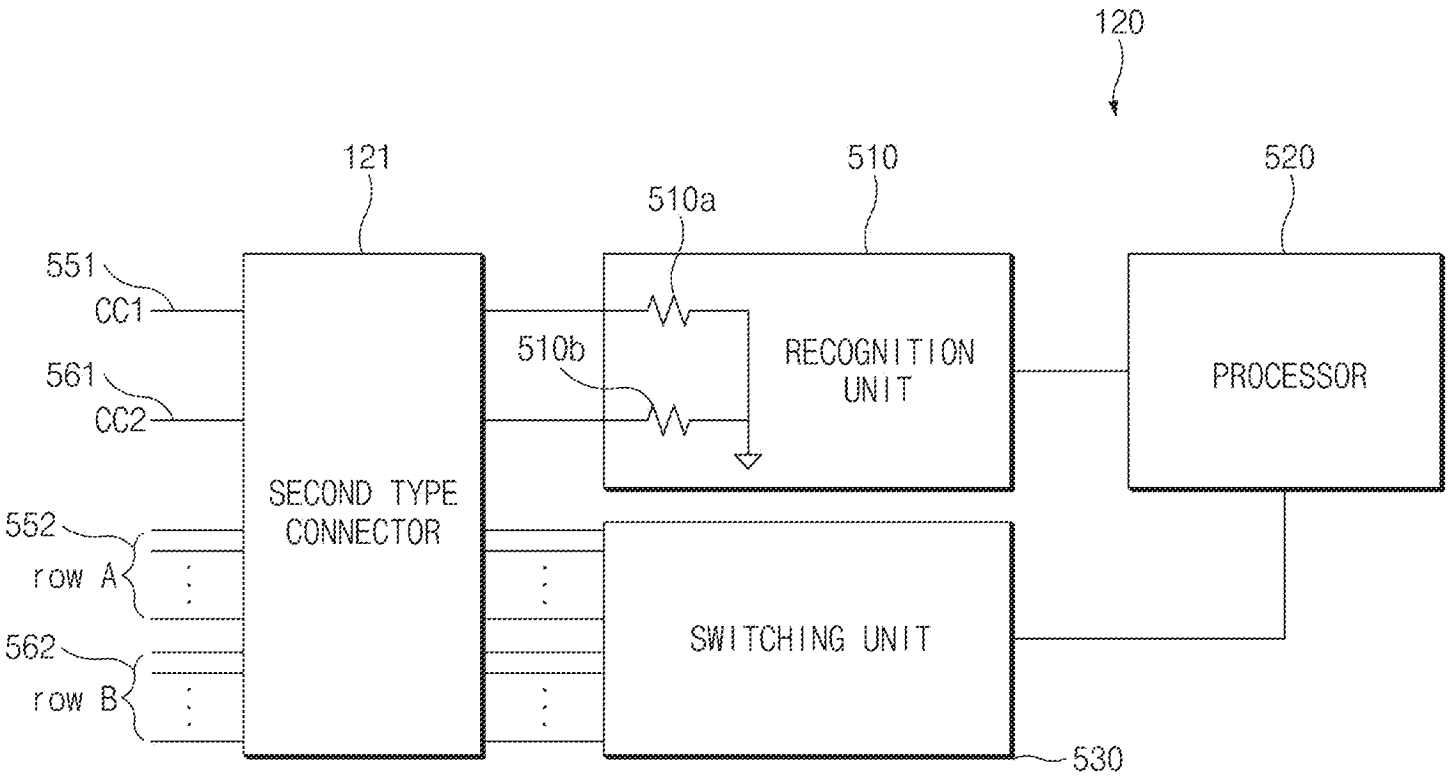
FIG. 5 illustrates a configuration of a second electronic device according to an embodiment of the present disclosure.

FIG. 5 illustrates a configuration of a second electronic device according to an embodiment of the present disclosure.

Referring to FIG. 5, the second electronic device 120 may include a second type connector 121, a recognition unit 510, a processor 520, and a switching unit 530.

The second type connector 121 may include a plurality of pins based on USB type C. For example, the second type connector 121 may include first to twenty fourth pins (for example, a power pin, a ground pin, and data pins Tx and Rx) based on the USB 3.1 (type C) standard.

The second type connector 121 may include a first sub pin row and a second sub pin row that are implemented to have a symmetrical arrangement. The first sub pin row may include first to twelfth pins (for example, pin CC1 551 and a row A data pin 552) based on USB 3.1. The second sub pin row has an arrangement that is symmetrical to the first sub pin row, and may include thirteenth to twenty fourth pins (for example, pin CC2 561 and a row B data pin 562) based on USB 3.1. Although FIG. 5 illustrates that pin CC and a data pin are separated from each other for convenience of description, they may be substantially adjacent to each other.

The recognition unit 510 may recognize a physical element (for example, a pull-up resistor) included in the connecting device 100 through pin CC1 551 and pin CC2 561. The recognition unit 510 may include a first pull-down resistor 510*a* connected to pin CC1 551 and a second pull-down resistor 510*b* connected to pin CC2 561. The recognition unit 510 may measure a voltage value applied to the pull-down resistors, and may provide the measurement result for a processor 520. In various embodiments, the recognition unit 510 may be implemented in a form in which the recognition unit 510 is included in a power management integrated circuit (PMIC) or in a form of a single control integrated chip (IC).

The processor 520 may receive voltage values applied to the first pull-down resistor 510*a* and the second pull-down resistor 510*b* from the recognition unit 510. The processor 520 may compare the voltage values with a preset reference value or compare the voltage values measured by the pull-down resistors to determine a sub pin row, to and from which data are transmitted and received.

For example, when the voltage applied to the first pull-down resistor 510*a* is a specific value or more (for example, 1.5 V or higher) and the voltage applied to the second pull-down resistor 510*b* is a specific value or less (for example, 0.5 V or lower), the processor 520 may determine a row A data pin 552 included in the same sub pin row as pin CC1 551 as an available data pin. In contrast, when the voltage applied to the second pull-down resistor 510*b* is a specific value or more (for example, 1.5 V or higher) and the voltage applied to the first pull-down resistor 510*a* is a specific value or less (for example, 0.5 V or lower), the processor 520 may determine a row B data pin 562 included in the same sub pin row as pin CC2 561 as an available data pin.

The switching unit 530 may select any one of the row A pin 552 and the row B pin 562 in response to a control signal of the processor 520. The second electronic device 120 may transmit and receive a signal to and from the outside through a data pin selected by the switching unit 530.

Figure 6:
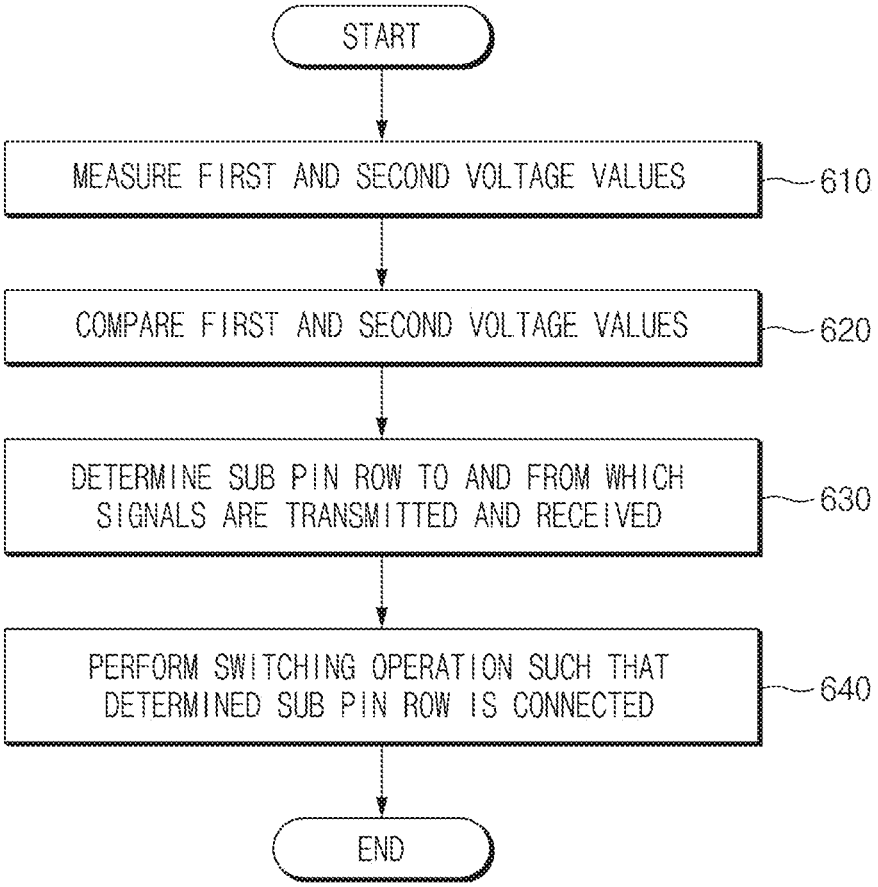
FIG. 6 is a flowchart illustrating a switching operation in a second electronic device according to an embodiment of the present disclosure.

FIG. 6 is a flowchart illustrating a switching operation in a second electronic device according to an embodiment of the present disclosure.

Referring to FIG. 6, in operation 610, the recognition unit 510 may measure first and second voltage values applied to the first pull-down resistor 510*a* and the second pull-down resistor 510*b*. In various embodiments, the recognition unit 510 may measure a voltage distribution between the pull-up resistor included in the connecting device 100 and the pull-down resistor included in the recognition unit 510 by using an analog-to-digital converter (ADC) voltage detector. The recognition unit 510 may provide the measurement result for the processor 520.

In operation 620, the processor 520 may compare the first and second voltage values or may compare the first and second voltage values with a preset reference value.

In operation 630, the processor 520 may determine a sub pin row, to and from which signals are transmitted and received, based on the comparison result.

When both the first voltage value and the second voltage value are less than or equal to a reference value, the processor 520 may determine that a separate external device is not connected and may terminate the device recognizing process.

When the first voltage value is a reference value or more and the second voltage value is less than or equal to a reference value (or a reference value or less), the processor 520 may transmit a control signal to the switching unit 530 such that data are transmitted and received through the row A data pin 552.

When the second voltage value is a reference value or more and the first voltage value is less than or equal to a reference value, the processor 520 may transmit a control signal to the switching unit 530 such that data are transmitted and received through the row B data pin 562.

According to various embodiments, when both the first voltage value and the second voltage value are a reference value or more (or more than a reference value), the processor 520 may determine that the connecting device 100 is directly connected to the second electronic device 120 while the cable 130 is not connected. The processor 520 may transmit a control signal to the switching unit 530 such that data are transmitted and received through any one of the row A pin 552 or the row B pin 562.

In operation 640, the switching unit 530 may perform a switching operation such that the determined sub pin row is connected in response to the control signal.

In various embodiments, the processor 520 may determine resistance values of the first and second pull-up resistors included in the connecting device 100, based on the first and second voltage values. The processor 520 may perform an operation corresponding to identifiers while taking the determined pull-up resistance values as the identifiers. For example, when it is recognized that the first and second pull-up resistance values are 10 kΩ, the processor 520 may recognize that the connecting device of company A is connected and perform an additional function related to the connecting device of company A.

According to various embodiments, a method for recognizing a device is performed by an electronic device that is connected to an external device through a connector, and may include measuring first and second voltage values applied to first and second pull-down resistors connected to first and second recognition pins of the connector, respectively, determining one of first and second sub pin rows provided in the connector, to and from which data are transmitted and received, based on the measured first and second voltages, and transmitting and receiving a signal through the determined sub pin row.

According to various embodiments, the determining of the sub pin row may include determining the sub pin row by comparing the first and second voltage values, or determining the sub pin row by comparing the first and second voltage values with a preset reference value. For example, the determining of the sub pin row may include, when both the first and second voltage values are larger than the reference value, transmitting and receiving a signal through one of the first and second sub pin row and interrupting connection with the other sub pin row. As another example, the determining of the sub pin row may include determining the sub pin row by comparing the first voltage value with a first reference value and comparing the second voltage value with a second reference value.

According to various embodiments, the determining of the sub pin row may include determining the sub pin row based on first and second pull-up resistance values provided in the external device recognized through the first and second voltage values.

According to various embodiments, the determining of the sub pin row may include determining one of first and second sub pin rows having arrangements that are symmetrical to each other.

According to various embodiments, the measuring of the first and second voltage values may include measuring the first and second voltage values in pin CC1 and pin CC2 of a connector corresponding to USB 3.1 type C.

According to various embodiments, the transmitting and receiving of the signal may include connecting a data pin provided in the determined sub pin row to an internal circuit of the electronic device through switching.

Figure 7:
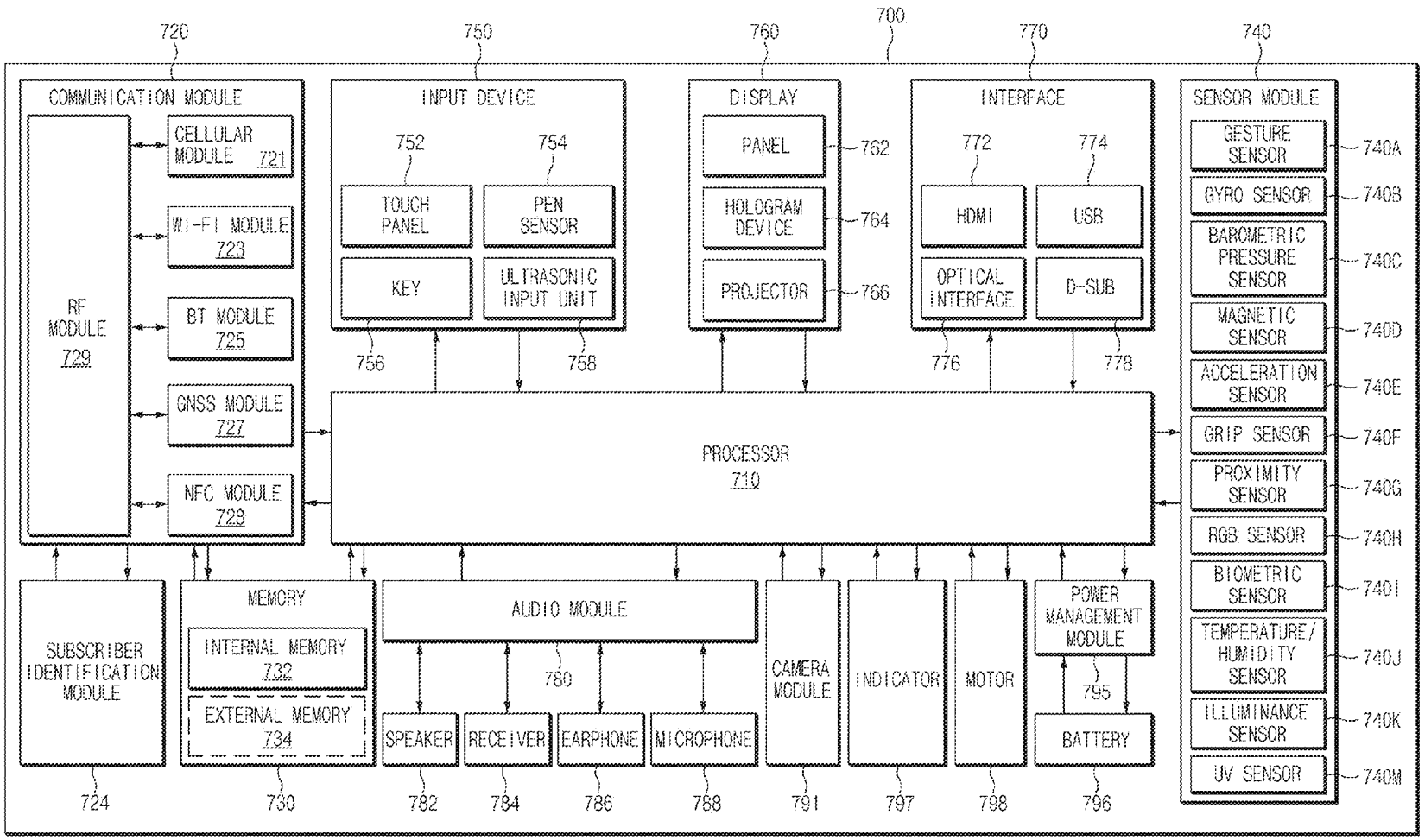
FIG. 7 is a block diagram of an electronic device according to an embodiment of the present disclosure.

FIG. 7 is a block diagram of an electronic device 700 according to an embodiment of the present disclosure. An electronic device 700 may include, for example, the entirety or a part of the first or second electronic device of FIG. 1. The electronic device 700 may include at least one processor (for example, an application processor (AP) 710), a communication module 720, a subscriber identification module (SIM) card 724, a memory 730, a sensor module 740, an input device 750, a display 760, an interface 770, an audio module 780, a camera module 791, a power management module 795, a battery 796, an indicator 797, or a motor 798.

The processor 710 may control a plurality of hardware or software elements connected to the processor 710 by driving an operating system or an application program and perform a variety of data processing and calculations. The processor 710 may be implemented by, for example, a system on chip (SoC). According to an embodiment, the processor 710 may further include a graphical processing unit (GPU) and/or an image signal processor. The processor 710 may include at least some (for example, a cellular module 721) of the elements illustrated in FIG. 7. The processor 710 may load instructions or data, received from at least one other component (for example, a non-volatile memory), in a volatile memory to process the loaded instructions or data, and may store various types of data in a non-volatile memory.

The communication module 720 may include, for example, a cellular module 721, a Wi-Fi module 723, a Bluetooth module 725, a GNSS module 727 (for example, a global positioning system (GPS) module, a Glonass module, a Beidou module, or a Galileo module), a near field communication (NFC) module 728, and a radio frequency (RF) module 729.

The cellular module 721 may provide a voice call, a video call, a text message service, or an Internet service through, for example, a communication network. According to an embodiment, the cellular module 721 may distinguish between and authenticate electronic devices 700 within a communication network using a subscriber identification module (for example, the SIM card 724). According to an embodiment, the cellular module 721 may perform at least some of the functions that the processor 710 may provide. According to an embodiment of the present disclosure, the cellular module 721 may include a communication processor (CP).

The Wi-Fi module 723, the Bluetooth (BT) module 725, the GNSS module 727, and the NFC module 728 may include a processor for processing data transmitted/received through the corresponding module. According to some embodiments, at least some (two or more) of the cellular module 721, the Wi-Fi module 723, the Bluetooth module 725, the GNSS module 727, and the NFC module 728 may be included in one IC or IC package.

The RF module 729 may transmit/receive, for example, a communication signal (for example, an RF signal). The RF module 729 may include, for example, a transceiver, a power amp module (PAM), a frequency filter, a low noise amplifier (LNA), or an antenna. According to another embodiment, at least one of the cellular module 721, the Wi-Fi module 723, the Bluetooth module 725, the GNSS module 727, or the NFC module 728 may transmit and receive an RF signal through a separate RF module.

The subscriber identification module 724 may include, for example, a card including a subscriber identification module and/or an embedded SIM, and may further include unique identification information (for example, an integrated circuit card identifier (ICCID)) or subscriber information (for example, international mobile subscriber identity (IMSI)).

The memory 730 may include, for example, an internal memory 732 or an external memory 734. The internal memory 732 may include at least one of, for example, a volatile memory (for example, a dynamic random access memory (DRAM), a static RAM (SRAM), a synchronous dynamic RAM (SDRAM), and the like) and a non-volatile memory (for example, a one-time programmable read only memory (OTPROM), a programmable ROM (PROM), an erasable and programmable ROM (EPROM), an electrically erasable and programmable ROM (EEPROM), a flash memory (for example, a NAND flash memory or a NOR flash memory), a hard driver, or a solid state drive (SSD).

The external memory 734 may further include a flash drive, for example, a compact flash (CF), a secure digital (SD), a micro secure digital (Micro-SD), a mini secure digital (Mini-SD), an eXtreme Digital (xD), or a memory stick. The external memory 734 may be functionally and/or physically connected to the electronic device 700 through various interfaces.

The sensor module 740 may measure, for example, a physical quantity or detect an operation state of the electronic device 700, and may convert the measured or detected information to an electrical signal. The sensor module 740 may include at least one of, for example, a gesture sensor 740A, a gyro sensor 740B, an atmospheric pressure sensor 740C, a magnetic sensor 740D, an acceleration sensor 740E, a grip sensor 740F, a proximity sensor 740G, a color sensor 740H (for example, red, green, and blue (RGB) sensor), a biometric sensor 740I, a temperature/humidity sensor 740J, an illumination sensor 740K, and a ultraviolet (UV) sensor 740M. Additionally or alternatively, the sensor module 740 may include an E-nose sensor, an electromyography (EMG) sensor, an electroencephalogram (EEG) sensor, an electrocardiogram (ECG) sensor, an infrared (IR) sensor, an iris sensor, and/or a fingerprint sensor. The sensor module 740 may further include a control circuit for controlling one or more sensors included therein. In some embodiments, the electronic device 700 may further include a processor configured to control the sensor module 740 as a part of or separately from the processor 710, and may control the sensor module 740 while the processor 710 is in a sleep state.

The input device 750 may include, for example, a touch panel 752, a (digital) pen sensor 754, a key 756, or an ultrasonic input device 758. The touch panel 752 may use at least one of, for example, a capacitive type, a resistive type, an infrared type, and an ultrasonic type. The touch panel 752 may further include a control circuit. The touch panel 752 may further include a tactile layer, and provide a tactile reaction to a user.

The (digital) pen sensor 754 may include, for example, a recognition sheet which is a part of the touch panel or a separate recognition sheet. The key 756 may include, for example, a physical button, an optical key, or a keypad. The ultrasonic input device 758 may detect ultrasonic waves generated by an input tool through a microphone (for example, a microphone 788) and may identify data corresponding to the detected ultrasonic waves.

The display 760 may include a panel 762, a hologram 764, or a projector 766. The panel 762 may be implemented to be, for example, flexible, transparent, or wearable. The panel 762 may be formed as a single module together with the touch panel 752. The hologram device 764 may show a three dimensional image in the air using an interference of light. The projector 766 may display an image by projecting light onto a screen. The screen may be located, for example, in the interior of or on the exterior of the electronic device 700. According to an embodiment, the display 760 may further include a control circuit for controlling the panel 762, the hologram device 764, or the projector 766.

The interface 770 may include, for example, a high-definition multimedia interface (HDMI) 772, a universal serial bus (USB) 774, an optical interface 776, or a D-sub-miniature (D-sub) 778. Additionally, or alternatively, the interface 770 may include, for example, a mobile high-definition link (MHL) interface, a SD card/multi-media card (MMC) interface, or an infrared data association (IrDA) standard interface.

The audio module 780 may bilaterally convert, for example, a sound and an electrical signal. The audio codec 780 may process voice information input or output through, for example, a speaker 782, a receiver 784, earphones 786, or the microphone 788.

The camera module 791 is a device which may photograph a still image and a dynamic image. According to an embodiment, the camera module 291 may include one or more image sensors (for example, a front sensor or a back sensor), a lens, an image signal processor (ISP) or a flash (for example, an LED or xenon lamp).

The power management module 795 may manage, for example, power of the electronic device 700. According to an embodiment of the present disclosure, the power management module 795 may include a PMIC, a charger integrated circuit (IC), or a battery or battery gauge. The PMIC may have a wired and/or wireless charging scheme. Examples of the wireless charging method may include, for example, a magnetic resonance method, a magnetic induction method, an electromagnetic wave method, and the like. Additional circuits (for example, a coil loop, a resonance circuit, a rectifier, etc.) for wireless charging may be further included. The battery gauge may measure, for example, a residual quantity of the battery 796, and a voltage, a current, or a temperature while charging. The battery 796 may include, for example, a rechargeable battery and/or a solar battery.

The indicator 797 may indicate particular status of the electronic device 700 or a part thereof (for example, the processor 710), for example, a booting status, a message status, a charging status, or the like. The motor 798 may convert an electrical signal into mechanical vibrations, and may generate a vibration or haptic effect. Although not illustrated, the electronic device 700 may include a processing device (for example, a GPU) for supporting mobile TV. The processing unit for supporting mobile TV may process, for example, media data pursuant to a certain standard of digital multimedia broadcasting (DMB), digital video broadcasting (DVB), or media flow (MediaFlo™).

Each of the elements described in the specification may include one or more components, and the terms of the elements may be changed according to the type of the electronic device. In various embodiments of the present disclosure, the electronic device may include at least one of the elements described in the specification, and some elements may be omitted or additional elements may be further included. Some of the elements of the electronic device according to various embodiments may be coupled to form one entity, and may perform the same functions of the corresponding elements before they are coupled.

According to various embodiments, a connecting device may include a first connector having a first pin row, a second connector having a second pin row, \a data line connecting a data pin of the first pin row and a data pin of the second pin row, and a recognition line connecting a power pin of the first pin row and a recognition pin of the second pin row through a physical element. The first connector may be connected to a first type connector mounted on a first external electronic device and the second connector may be connected to a second type connector mounted on a second external device.

According to various embodiments, a direction of the first connector is inserted into the first type connector may be determined in advance, and the second connector may have a compatibility with the insertion direction of the second type connector. For example, the first connector may correspond to one of USB type A, USB type B, and USB type micro B, and the second connector may correspond to USB type C.

According to various embodiments, the second pin row may include a first sub pin row and a second sub pin row having an arrangement that is symmetrical to the first sub pin row. The data line may connect one data pin of the first pin row to a data pin of the first sub pin row or a data pin of the second sub pin row. The physical element may include a first pull-up resistor disposed between a power pin of the first pin row and a recognition pin of the first sub pin row, and a second pull-up resistor disposed between a power pin of the first pin row and a recognition pin of the second sub pin row. The recognition pin may be a channel configuration (CC) pin based on USB 3.1 standard.

According to various embodiments, the connecting device may further include a circuit board, on which the data line and the recognition line are mounted, and a housing, on which the first and second connectors and the circuit board are mounted.

According to various embodiments, the second connector may be connected to a second type connector mounted on an external electronic device through a separate cable. The second pin row may include a first sub pin row and a second sub pin row having an arrangement that is symmetrical to the first sub pin row, and one of the first sub pin row and the second sub pin row may be connected to the second type connector through the cable.

The term "module" used in the specification may mean a unit including, for example, one of hardware, software, or firmware or a combination of the two or more of them. The module may be interchangeably used, for example, with a unit, a logic, a logical block, a component, or a circuit. The module may be a minimum unit or a part of an integrally configured part. The module may be a minimum unit or a part which performs one or more functions. The module may be implemented mechanically or electromagnetically. For example, the module may include at least one of an application-specific integrated circuit (ASIC) chip, a field-programmable gate array, or a programmable-logic device, which has been known, will be developed in the future, or performs certain operations.

At least some of the devices (for example, modules or functions) or methods (for example, operations) according to various embodiments of the present disclosure may be implemented by an instruction stored in a computer-readable storage medium, for example, in the form of a program module. When the instruction is executed by the processor (for example, the processor 710), the at least one processor may perform a function corresponding to the instruction. The computer-readable storage medium may be, for example, a memory.

The computer-readably storage medium may include a hard disk, a floppy disk, a magnetic medium (for example, a magnetic tape), an optical medium (for example, a compact disk read only memory (CD-ROM)), a DVD, a magneto-optical medium (for example, an optical disk), a hardware device (for example, a read only memory (ROM), a random access memory (RAM), or a flash memory). Further, the program instructions may include high-level language codes which may be executed by a computer using an interpreter as well as machine languages created by using a compiler. The above-mentioned hardware device may be configured to be operated as one or more software module to perform operations of various embodiments, and the converse is true.

The module or program module according to various embodiments of the present disclosure may include at least one of the above-mentioned element, omit some of them, or further include other elements. The module, the program module, or the operations performed by other elements according to various embodiments of the present disclosure may be performed in a sequential, parallel, iterative, or heuristic method. Further, some operations may be executed in another sequence or may be omitted, or other operations may be added. Further, the embodiments disclosed in the specification are provided to describe the technical contents or for understanding of the technical contents, and the technical scope of the present disclosure is not limited thereto. Accordingly, the scope of the present disclosure should be construed to include all changes or various embodiments based on the technical spirit of the present disclosure.

According to various embodiments of the present disclosure, the connecting device may connect a power pin of a first connector and a recognition pin of a second connector by using a physical element and an external device may determine a pin, to and from which data are transmitted and received, by recognizing a physical element connected to the recognition pin.

According to various embodiments of the present disclosure, the connecting device does not have a separate branch line so that distortion of signals is reduced and manufacturing costs, for example, of a cable or a gender are reduced.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A connecting device comprising:

a first connector comprising a first pin row;

a second connector comprising a second pin row;

a data line connecting a data pin of the first pin row and a data pin of the second pin row; and a recognition line connecting a power pin of the first pin row and a recognition pin of the second pin row through a physical element.

2. The connecting device of claim 1, wherein the first connector is connected to a first type connector mounted on a first external electronic device, and wherein the second connector is connected to a second type connector mounted on a second external electronic device.

3. The connecting device of claim 1, wherein a direction in which the first connector is inserted into the first type connector is determined in advance, and wherein the second connector is compatible with an insertion direction of the second type connector.

4. The connecting device of claim 3, wherein the first connector corresponds to one of universal serial bus (USB) type A, USB type B, and USB type micro B, and wherein the second connector corresponds to USB type C.

5. The connecting device of claim 1, wherein the second pin row comprises:

a first sub pin row, and a second sub pin row having an arrangement that is symmetrical to the first sub pin row.

6. The connecting device of claim 5, wherein the data line connects one data pin of the first pin row to a data pin of the first sub pin row or a data pin of the second sub pin row.

7. The connecting device of claim 5, wherein the physical element comprises:

a first pull-up resistor disposed between the power pin of the first pin row and a recognition pin of the first sub pin row; and a second pull-up resistor disposed between the power pin of the first pin row and a recognition pin of the second sub pin row.

8. The connecting device of claim 1, wherein the recognition pin is a channel configuration (CC) pin based on universal serial bus (USB) 3.1 standard.

9. The connecting device of claim 1, further comprising:

a circuit board, on which the data line and the recognition line are mounted; and a housing, on which the first and second connectors and the circuit board are mounted.

10. The connecting device of claim 1, wherein the second connector is connected to a second type connector mounted on an external electronic device through a separate cable.

11. The connecting device of claim 10, wherein the second pin row comprises a first sub pin row and a second sub pin row having an arrangement that is symmetrical to the first sub pin row, and wherein one of the first sub pin row and the second sub pin row is connected to the second type connector through the cable.

* * * * *